United States Patent [19]

Groeger

[11] 4,453,508

[45] Jun. 12, 1984

[54] FLEXIBLE CYLINDER ENGINE

[76] Inventor: Theodore O. Groeger, 2 Collamore Cir., West Orange, N.J. 07052

[21] Appl. No.: 313,559

[22] Filed: Oct. 22, 1981

[51] Int. Cl.[3] ..... F02F 1/10; F01B 19/00

[52] U.S. Cl. ..... 123/193 P; 123/193 R; 123/200; 92/90

[58] Field of Search ..... 123/200, 241, 193 R, 123/193 P, 44 E, 55 A; 418/45; 92/89, 90, 92

[56] References Cited

U.S. PATENT DOCUMENTS

| | | | |
|---|---|---|---|
| 652,035 | 6/1900 | Michon | 418/45 |
| 2,581,830 | 1/1952 | Averill | 418/45 |
| 3,007,416 | 11/1961 | Childs | 92/90 |
| 3,203,356 | 8/1965 | Jepsen | 92/92 |
| 3,561,892 | 2/1971 | Achermann et al. | 92/89 |
| 3,628,898 | 12/1971 | Bragdon | 418/45 |
| 3,870,437 | 3/1975 | Gondek | 418/153 |
| 3,872,852 | 3/1975 | Gilbert | 123/193 R |
| 4,044,728 | 8/1977 | Moeller | 123/193 R |

FOREIGN PATENT DOCUMENTS

| | | | |
|---|---|---|---|
| 166077 | 7/1921 | United Kingdom | 123/241 |

*Primary Examiner*—William R. Cline
*Assistant Examiner*—John K. Ford
*Attorney, Agent, or Firm*—Theodore O. Groeger

[57] ABSTRACT

A pumping or combustion engine having one to four cylindrical or semi-cylindrical chambers formed by at least one flexible sheet attached to a rotor, which sheet and/or rotor contact a plane, rigid plate at both sides thereof, containing inlet and exhaust ports for gases and/or liquids therein, which ports are opened and closed by the sheet, rotor, and/or spring-loaded check valves; and the volume of each chamber is varied when flexing the sheet by the reciprocal or rotational momentum of the rotor(s) alone, or its rotation along outer or inner, stationary or moveable, spring-loaded rigid cylinders (rollers).

6 Claims, 19 Drawing Figures b c d b b c b c

FLEXIBLE CYLINDER ENGINE

BACKGROUND OF THE INVENTION

Of all engines, i.e. machines converting any energy into mechanical motion, the heat engine is utilized most widely, despite its theoretical and practical shortcomings, e.g. low efficiency and torque at practical temperature and speed ranges. Basically, it requires a container (chamber) of variable volume, for which the rigid, right, circular or trochoidal cylinder with movable piston is chosen most often, in spite of the high material and manufacturing costs encountered in the precision-shaping of any body with curved surface.

Accordingly, both vehicle engines and power-generating turbines, and even rotary engines with flexible combustion chamber according to U.S. Pat. No. 3,872,852, contain expensive, rigid parts with curved surfaces. In contrast, the engines described and claimed herein, especially those depicted by FIGS. 8*a* to *c*, contain mainly rectangular parts, all of the surfaces thereof are either plane while manufactured; or if curved, obtained by non-precision stamping and stacking of a plurality of sheets.

Moreover, simpler and more integrated combinations of internal combustion engine and electric motor/generator are not yet available for the more efficient hybrid (gas/electric) vehicles, e.g. those described in the Aug. 14, 1980 New Scientist, pages 531–4, or U.S. Pat. Nos. 4,011,919 and 4,165,846 respectively, although it has been proven already that such vehicles offer about twice the gas-mileage of today's vehicles, due to regenerative charging of their batteries while braking, and the more efficient electric drive, offering, in contrast to the gas engine, maximum torque at low speed. The engines described and claimed herein, especially those depicted by FIGS. 1*a–d* to 4, do allow such desired combinations with electric motor/generators.

SUMMARY

The present invention concerns and has for its object the provision of a light and simple engine with a minimum amount of precision-shaped rigid curved surfaces. It ranges from a pump for moving gases, liquid or suspensions, to a heat engine, preferably an internal combustion engine, and its combination with an electric motor/generator.

Said new engine comprises at least one: (a) rotatable shaft connected to a load and rotor; (b) flexible, cylindrical sheet attached to said rotor; (c) rigid plate contacting opposite sides of said sheet each, thereby forming a flexible cylinder with it; (d) inlet and exhaust port within either of said plates and communicating with said cylinder; and (e) reciprocating or rotating flexing means within or without said cylinder, capable of varying its volume periodically.

A cylindrical surface, defined herein, is that traced by a straight generatrix moving perpendicular to a closed directrix, such as a circle, ellipse, oval, or two connected trochoids or sine curves, i.e. said flexible cylinder is a finite surface composed of one curved (sheet), and two plane sides (plates). This invention also concerns any new part and combination of parts disclosed herein, the process for their manufacture, and their use.

BRIEF DESCRIPTION OF THE DRAWINGS

FIGS. 1*a* to *d* is a front view into the opened FIG. 2 single cylinder, 2-cycle engine-electric motor/generator combination at plane B.

FIGS. 6*a* to *d* is a front view into the opened FIG. 5 engine at plane E.

FIG. 7*b* is a perspective view of the FIGS. 5/6*a* engine's middle part.

FIGS. 8*a* to *c* is a front, top and partial view of a single or double cylinder, 4-cycle engine.

Said simplified drawings illustrate schematically the outskirts of the present invention, and the numerals 1–28 therein refer to similar parts throughout the specification. They are collectively defined as follows: 1=shaft, 2=rotor, 3=flexible cylinder, 4=rigid cylinder, 5=cylinder support, 6=spring, 7=spring support, 8=fuel injector, 9=glow or spark plug, 10=exhaust port, 11=intake port, 12=inlet valve, 13=gas duct, 14=cooling duct, 15=cooling fins, 16=electric magnet, 17=permanent magnet, 18=commutator, 19=screw, 20=cable, 21=spur gear, 22=exhaust valve, 23=drainage, 24=electric motor/generator, 25=worm gear, 26=cam, 27=nut or spot welding, 28=seal, 29=housing.

If not indicated otherwise, all gas and/or electrically powered rotors, depicted herein, rotate clock-wise.

DESCRIPTION OF THE PREFERRED EMBODIMENTS

Figure 8A:
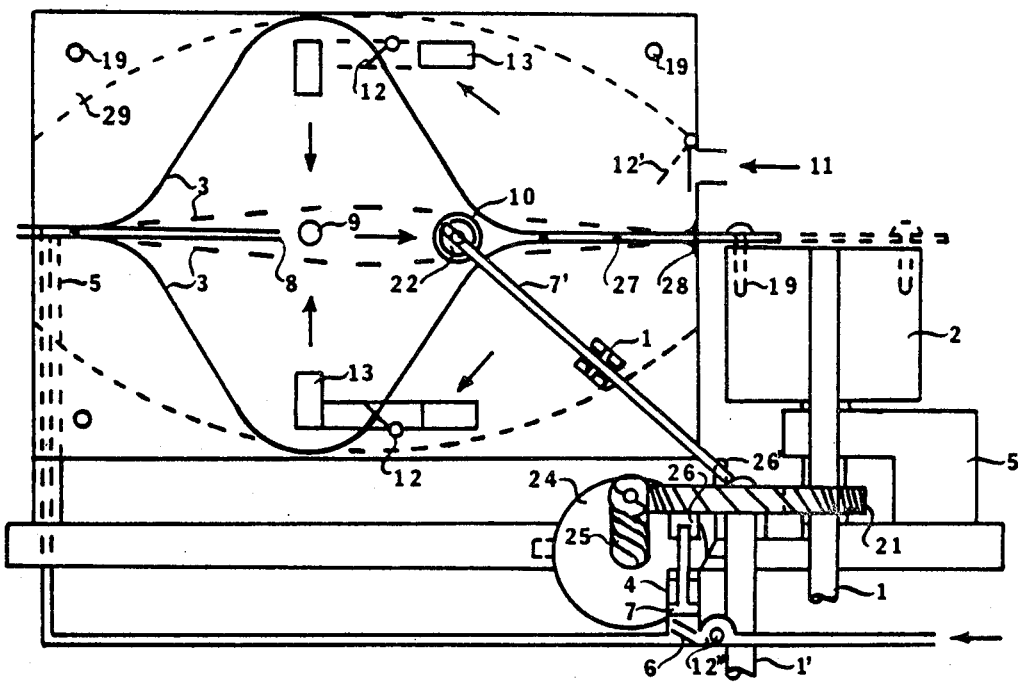

FIGS. 8*a* to *c* illustrate the embodiment closest to that invented by N. A. Otto. Therefore, most of his timeless words (taken from his U.S. Pat. No. 194,047, column 4) shall be chosen for describing "The mode of operating with this engine" also: Assuming the flexible cylinder 3 to be at the end of the outstroke (represented by the broken lines 3 in FIGS. 8*a* and *b*), and about to be moved through its instroke by the momentum of the rotor 2 and screw 19 therein, then the spring-loaded (one-way) inlet valve 12' had been in a position to admit atmospheric air through the intake port 11 of the cylinder's housing 29. Air will be drawn into the cylinder 3 when the flexible sheet thereof reaches the gas duct 13, which is in communication, via the similar duct valve 12 therein, with the now compressed air within the housing 29, having seals 28 thereon, until cylinder 3 has arrived at the end of its instroke, i.e. the most flexed position shown in FIG. 8*a*. The duct valve 12 having moved so as to close duct 13 (but another valve 12' is opening port 11), the cylinder 3 is caused by its tension, and the rotor 2, to perform its outstroke, whereby the air therein will be compressed. The wedge-type cam 26 at the lower side of the larger spur gear 21' (which is so proportioned that it makes one revolution while the cylinder 3 makes two double strokes) now forces the plunger-type spring support 7 (whose terminal part opposite to spring 6 is an injector piston) within the rigid fuel cylinder 4 down, so that the injector 8 enters combustible particles close to the spark plug 9, which is activated during the cam-plunger-contact also, closing the ignition's primary circuit (not shown). Ignition causes a gradual development of heat and expansion of the gases, whereby the cylinder 3 will be caused to perform its instroke, imparting fresh momentum to the rotor 2 at the faster rotating shaft 1. It will again cause the cylinder's outstroke, whereby the products of combustion will be expelled through the exhaust valve 22 and port 10, which has been opened by the lever-type spring support 7' (whose terminal part is a rocker arm), acted on by the bolt-type cam 26' at the upper side of the larger spur gear 21'. As the pressure within cylinder 3 (sliding in its housing 29, which is journalled at the cylinder support 5 and deflected by the rotor 2 to the lateral positions, shown by the housing's broken lines 29 in FIG. 8*b*) rapidly decreases, a small portion of pressurized air within the housing 29 enters before the cylinder 3 moves beyond the opening of duct 13 into the initial position (marked by solid and broken lines in FIG. 8*a*, depending on its front- or rear-positioning), so that virtually no products of combustion will remain in the flexible cylinder 3.

The power of the engine may be regulated by the quantity of combustible fuel introduced at each charge. This is effected by the minute up- or down-sliding of the slower moving shaft 1', carrying the larger spur gear 21' with both cams 26 and 26' thereon, so that the plunger 7 (supported by spring 6 next to the ball-type valve 12'') drives various fuel amounts through the injector 8, and both shafts 1 and 1' may be connected to a load at the gear-ratio of 1:2. Moreover, the amount of air, drawn into the cylinder 3, may be regulated by increasing or decreasing the opening resistance of the inlet valves 12 within duct 13, e.g. by a spring thereon, which is connected to the gas pedal (moving the camshaft 1' also) by lever or cable.

Figure 8A:
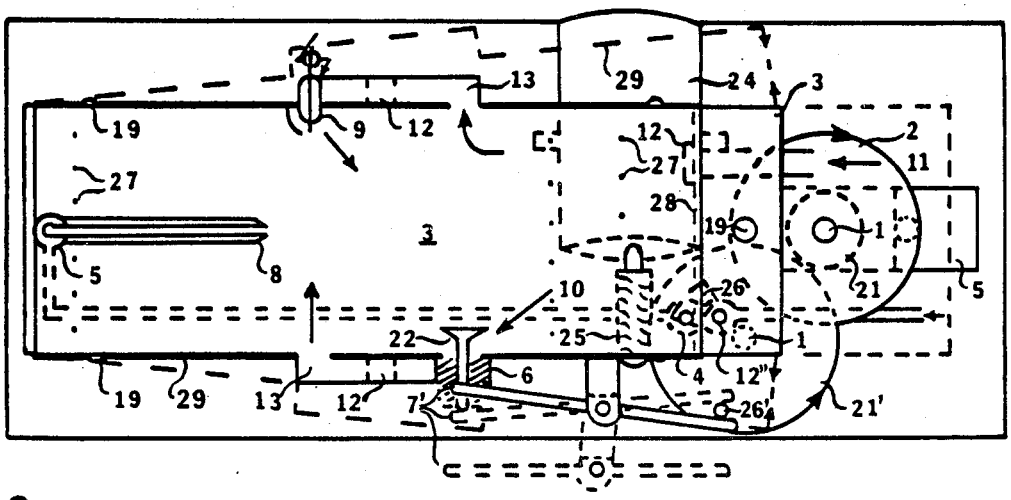
Figure 8A:
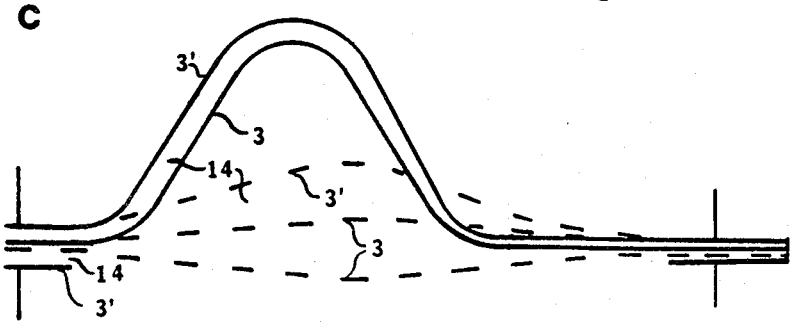

The FIG. 8 engine is started and/or fix connected with the electric motor/generator 24, which is journalled within the engine's base, and engaged with said larger spur gear 21' by lifting the worm gear 25, at the motor's shaft, out of the horizontal (disengaged) position, e.g. by a starter pedal (not shown).

Although cool, preferably water-saturated air enters the cylinder housing 29 at port 11 at twice the rate necessary for combustion, it may not cool the cylinder 3 sufficiently when vibrating at high speed. Therefore, said single cylinder, composed of two rectangular sheets joined by the nuts or welding spots 27, may be substituted by the double cylinder partly depicted by FIG. 8*c*, in which the cooling duct 14 between the four sheets 3 and 3' (properly separated at the support 5 by two or more insets) sufficiently varies its volume while flexing, so that cooling air need not be forced through it. Moreover, part of the pressurized air within the cylinder's housing 29 will escape through the ducts 14 also, thus increasing the volume of cool air entering through the intake port 11 and ventilating the engine. Said cooling ducts 14 are advantageously connected with the lubrication system also, for providing a smooth gliding of said cylindrical sheets along the plane, rigid side-plates of said housing 29, the volume of which may be diminished (as indicated in FIG. 8*a* by semicircular broken lines 29) by properly dimensioned insets, in order to increase the charging air pressure within, and any losses thereof may be diminished by the seals 28. Accordingly, the Ottomotor has been simplified to the original rod-crankshaft-flywheel-assembly, and the rigid, circular doubly cylinder thereof substituted by a flexible, doubly sinus-curved cylinder within a rectangular box, all of which surfaces being plane while manufactured.

Figure 1A:
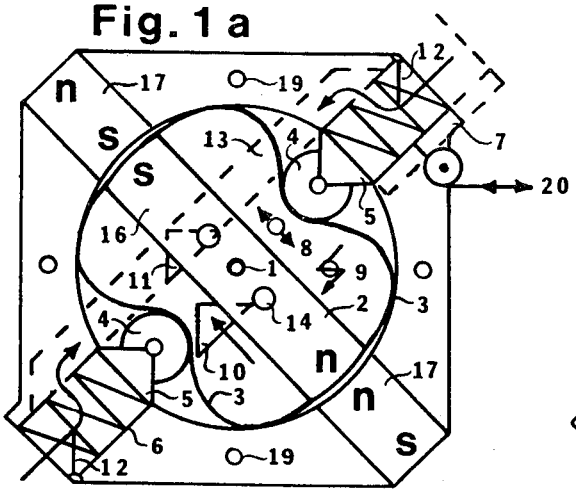
Figure 1A:
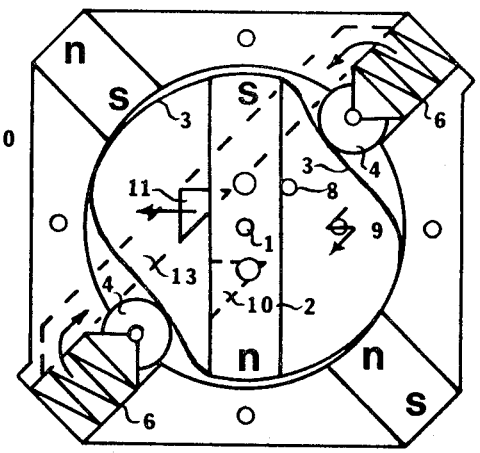
Figure 1A:
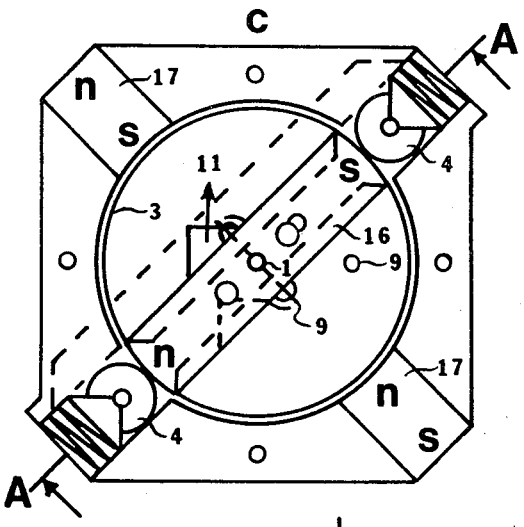
Figure 1A:
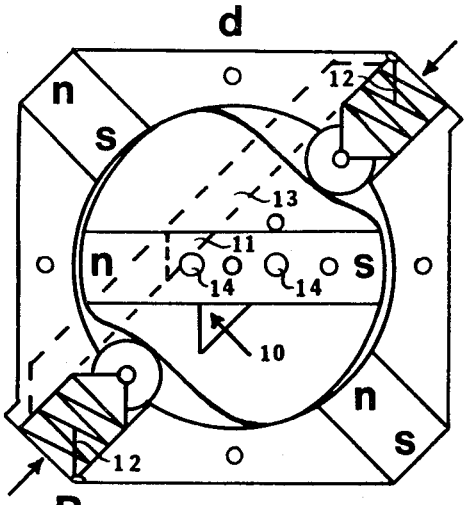

FIGS. 1*a* to *d* and 2 depict a conventional electric motor/generator whose rotor 2 is a (somewhat leaner) electric magnet 16, which has been augmented, according to this invention, with the flexible cylinder 3, and one pair of whose stator's permanent magnets 17 substituted by the flexing means for said cylinder, i.e. rigid cylinders (rollers) 4 variably pressed thereon by the springs 6 at their supporters 7 via the cable 20. FIG. 1*a* shows the cylinder 3, equally partitioned by the rotor 2, in its most flexed ignition position (top right, with activated fuel injector 8 and spark plug 9) and exhaust position (lower left), showing a communication between exhaust port 10 and intake port 11 via the cooling ducts 14, and air has been blown, through the spring-loaded (one-way) inlet valves 12, into the generator's cavity, occupied by the cylinders 4 and their supporters 5 also. FIG. 1*b* shows the rotor's closing of the exhaust port 10 and opening of intake port 11, while both cylinder-halves are expanding, compressing the air within said cavity and the former closes valves 12 and moves via duct 13 and port 11 into the left hemicylinder. FIG. 1*c* depicts the end of the power and intake stroke, and FIG. 1*d* half of the compression and exhaust stroke, so that after a single revolution said events are repeated, like in a 2-cycle engine, with actually 4 cycles performed. Due to the fact that compression and exhaust strokes require different forces acted upon the cylinders 4, the upper springs 6 must be stiffer than the lower. In order to facilitate an easy starting of this engine-generator combination, at least the stiffer springs' support 7 is telescoped out, as shown in FIG. 1*a* by broken lines, by releasing the cable 20, and the motor is activated by entering current via the commutator 18 shown in FIG. 2. It also depicts the conventional assembly of this engine-generator from stamped sheets, which is the currently cheapest manufacture of complex rigid bodies. Accordingly, a stack of soft iron plates, separated by Eddy-insulators and cooling fins 15, steel or duralumin end-plates with stamped-out exhaust and intake ports 10, 11, as well as ducts 13, and bearings for the shaft 1, injector 8 and spark plug 9, is held together by the screws 19, and augmented with the permanent magnets 17, light metal cylinders 4, their supports 5, springs 6 and their supports 7.

The power of this engine-generator may be regulated by both the fuel- and air-quantity within the flexible cylinder 3, which latter can be manipulated by the cable 20, as explained for the start-up. Since air from two generator cavities enters into one hemicylinder per revolution, the proper dimensioning of the former, as well as of the rollers 4 and ports 10, 11, may compensate for the low compression ratio achieved with this embodiment.

Figure 2:
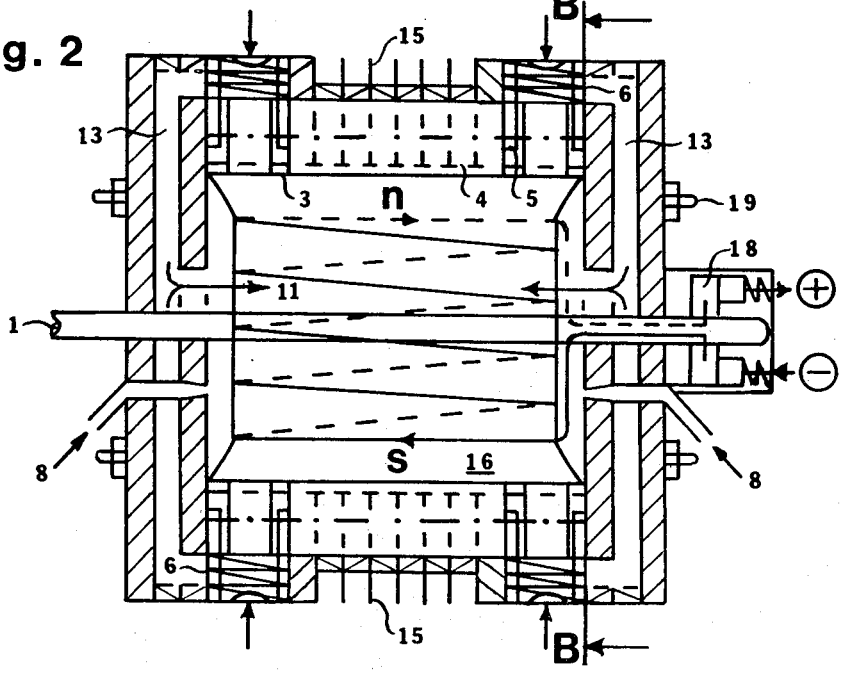
FIG. 2 is a cross-sectional view of said FIG. 1*c* engine-generator at plane A.
Figure 3A:
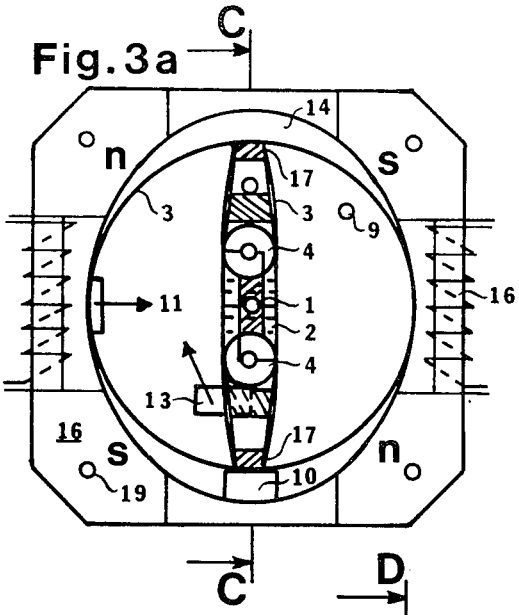
FIGS. 3*a* and *b* is a front view into the opened FIG. 4 double cylinder, 2-cycle engine-generator at plane D.

FIGS. 3*a,b* and 4 depict a simpler and faster running reciprocal version of the former engine-generator, whose stator-housing contains two electric magnets 16, and rotor 2 two permanent magnets 17, which are augmented with a flexible double cylinder of the FIG. 8*c*-type, which is flexed by the rigid cylinders (rollers) 4, at their supports 5, held at the desired distance by the cables 20. FIG. 3*a* shows the least deformed double cylinder 3 at the end of its power (right half) and intake stroke (left half), when air from the oval housing enters through the intake port 11, as well as air from the inner cylinder enters through the duct 13. FIG. 3*b* shows the most deformed double cylinder 3 at the end of its compression (upper half) and exhaust stroke (lower half), when the combustion gases escape through port 10 and fresh air enters through the port 11 and inlet valve 12 into the inner cylinder. The latter forces the L-shaped halves of the rotor 2 (gliding or telescoping into each other) into their closest position, activating both injector 8 and spark plug 9 within the rigid end-plates, closing the outer (upper) hemicylinder also. The start-up of this engine-generator is again facilitated by releasing the cables 20, so that the inner cylinder moves the rollers 4 at the sliding supports 5 into their closest position also, thus minimizing the flexing of the double cylinder 3, or the required motor-torque respectively, which is generated by the current entering through the commutator 18. At full rotational speed the tension of cables 20 is increased by the gas pedal, whereby the air intake and injected fuel amount, as well as the compression ratio is increased also, and the activated spark plug will activate the engine part, while the stator magnets 16 return current. This engine-generator may be conventionally cooled by forcing air through the ducts 14 of the oval stator cavity, e.g. by a propeller or turbine attached to the shaft 1, as usual for the FIGS. 1,2 design.

Figure 4:
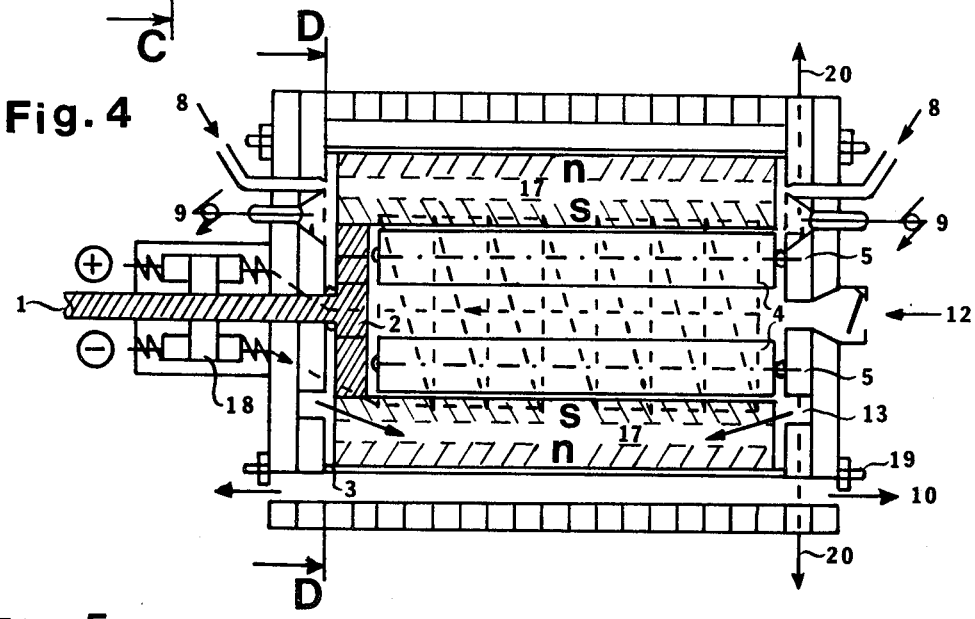
FIG. 4 is a cross-sectional view of said FIG. 3*a* engine-generator at plane C.
Figure 5:
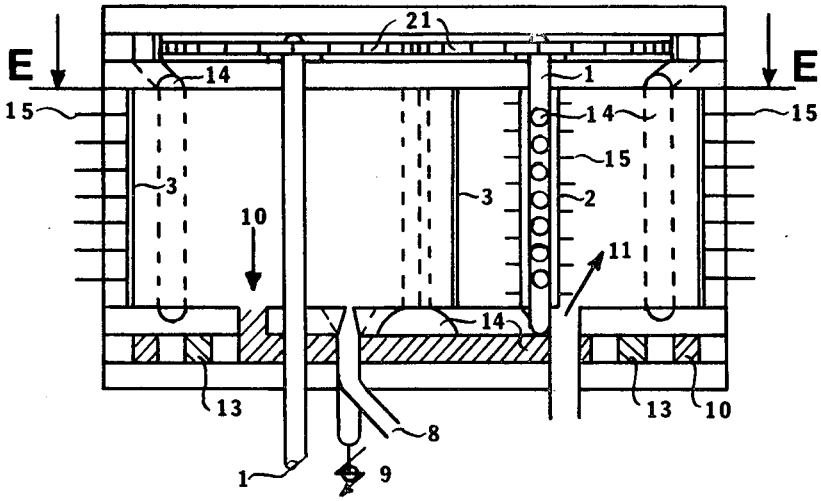
FIG. 5 is a cross-sectional view of the FIG. 6*c* double cylinder, 2-cycle engine at plane F.
Figure 6A:
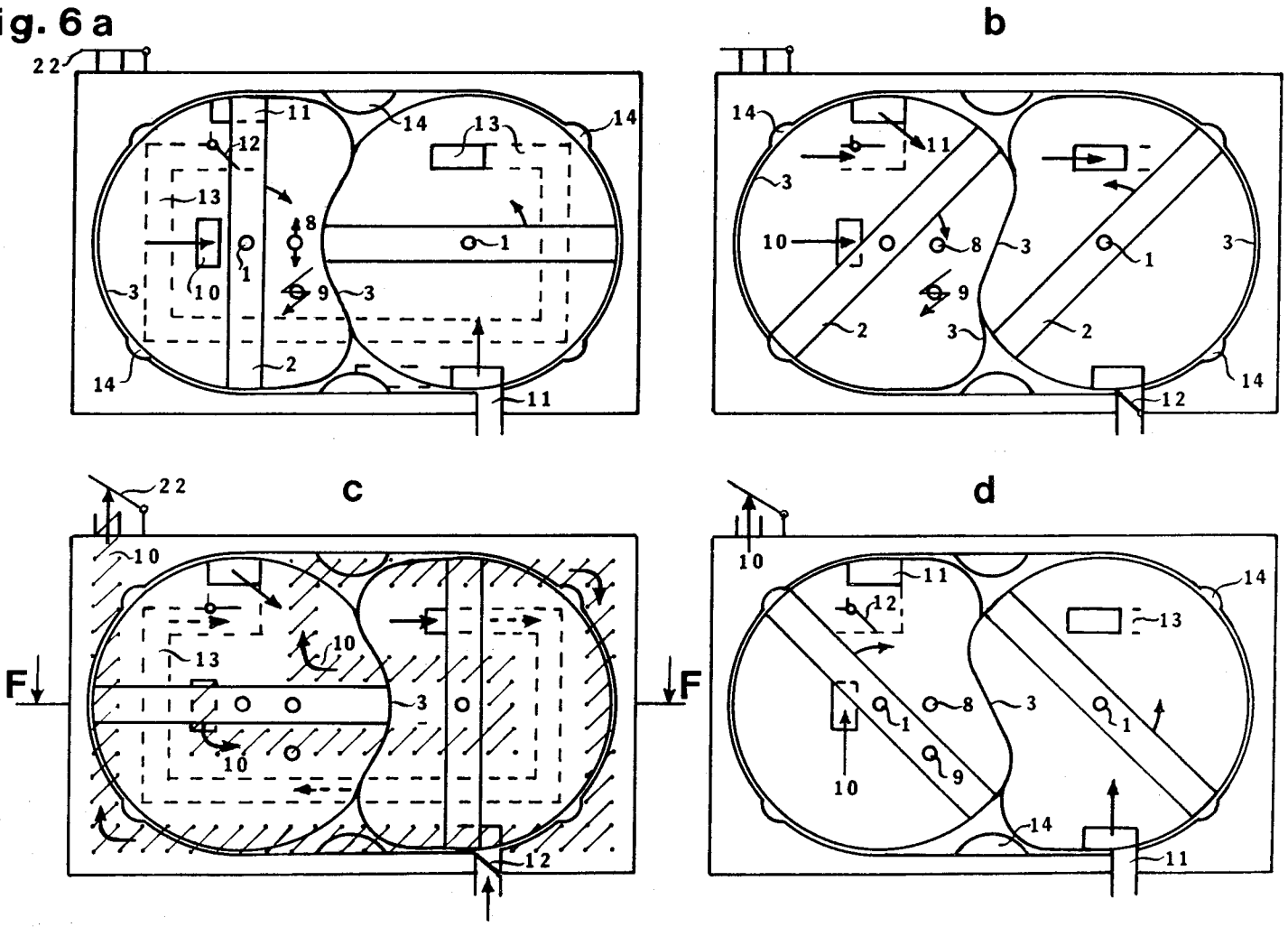
Figure 7A:
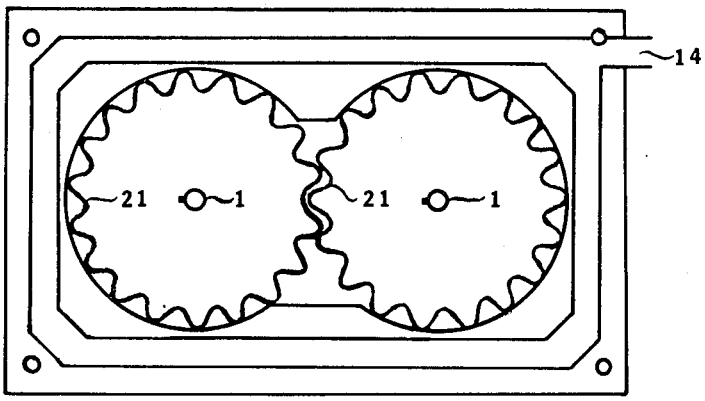
FIGS. 7*a* and *c* is the top view of both penultimate end-plates of the FIGS. 5/6 engine.

FIGS. 5, 6*a* to *d*, and 7*a* to *c* depict a double cylinder engine operating similar to that of FIGS. 1 and 2, whose shafts 1, rotors 2 and flexible cylinders 3 are located within a transparent housing composed of the eight plate and seven cooling fin 15-stack of FIG. 7*b*, the front plate of FIG. 6*b*, a similar end plate with cooling ducts 14 only, the adjacent plates of FIGS. 7*a* and *c*, and another pair of final plates (analogous to the plates closing the cylinders' cavity) as shown by FIG. 5. All fourteen plates are held together by four screws 19 as in FIG. 4 (but omitted in FIGS. 5,6). FIG. 6*a* shows the left hemicylinder at full exhaust position with open port 10, the adjacent hemicylinder 3 at the beginning of the power stroke with activated injector 8 and spark plug 9, and both right hemicylinders filled with air drawn through the intake port 11. FIG. 6*b* shows the transfer of air from the right, upper hemicylinder through the long duct 13 (shown by broken lines in FIGS. 6*a* and *c* only) into the left hemicylinder, flushing the last combustion products out. FIG. 6*c* shows the completion of said transfer from the most flexed hemicylinder 3 into its left, upper counterpart, when the combustion gases within the left, lower hemicylinder start escaping through the exhaust port and long duct 10 leading to the exhaust valve 22, in order to preheat said transferred air within duct 13. FIG. 6*d* depicts compression of air within the left, flexed hemicylinder, while the inlet valve 12 within duct 13 is closed, and intake of fresh air through port 11 into the right, flexed hemicylinder 3. FIG. 7*a* shows the penultimate end-plate, whose separate pieces (forming the cooling duct 14) are held in place by the spur gears 21 at the shafts 1, also keeping the cylinders 3 at the rotors 2 in proper position. In order to facilitate the heat transfer, cold air is circulated through the cooling ducts 14 and partly recirculated to the intake port 11, as shown in FIG. 7*b*. Also the fins 15 at the housing and within the right, charging cylinder 3 serve the same purpose, i.e. raising the heat efficiency of this engine, and keeping the temperature thereof near the water's condensation point, as symbolized by the drainage 23 in FIG. 7*c*, and the closed exhaust valve 22 as well. This engine may also run at high speed, because the only reciprocating parts thereof are the cylindrical sheets in its centerline, pushed by the rigid rotors to the left or right.

DESCRIPTION OF EQUIVALENT EMBODIMENTS

Having described and schematically depicted (for graphical simplicity and clarity) a few specific, most exemplary embodiments of this invention, the following lists some of the obvious equivalents or derivations thereof. Thus, for example, the FIG. 8 engine needs no separate starter motor 24, if its rotor 2 is that of a FIG. 1 or 2-type electric motor/generator. Moreover, its cylinder-housing may be kept in place, if either a rod is inserted between the rotor 2-cylinder 3-connection (19), or the circular hole within the cylindrical sheets (admitting screw 19) widened to a slot of the strokes' width. In such modification the whole rotor-starter-combination can be placed into the cylinder-housing 29 also, thus eliminating the wide opening and seals 28 therein. The shape of the duct 13-ports will, of course, not be rectangular, but in conformity with the cylinder's apex. Also the intruding injector 8 may be replaced by the pair of FIG. 2, and the symmetrical ignition at both plates, and exhaust ports 10 located near both sheet-proximities, will prove advantageous as well.

Figure 7A:
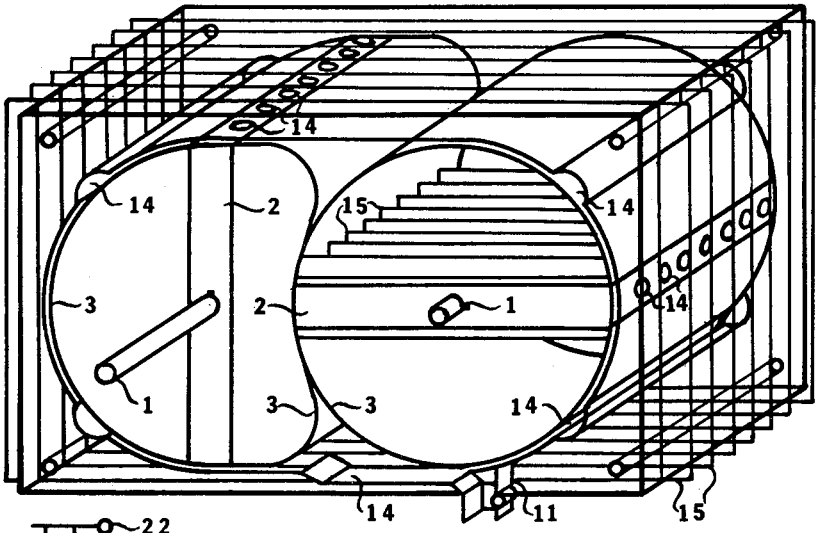
Figure 7A:
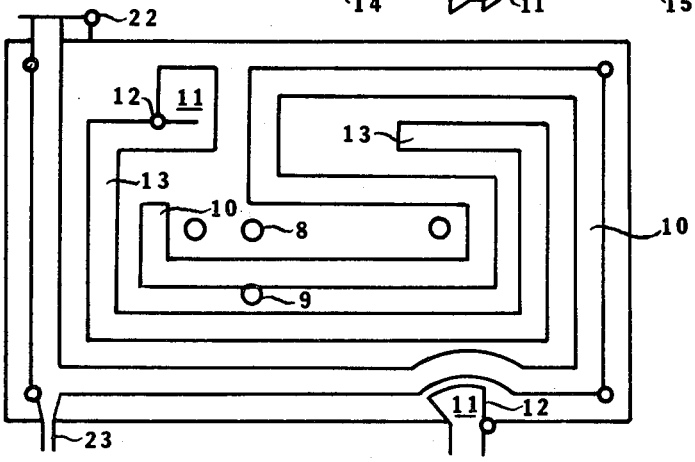

In the FIGS. 1,2 engine-generator, only the softer springed (left) rollers 4 may be retained for the exhaust stroke, but the compression stroke performed analogous to the FIGS. 5,6,7 engine, whereby both central hemicylinders provide two power strokes per revolution, and the peripheral spring-flexed hemicylinders for the exhaust, thus doubling the efficiency of the latter engine, and reducing the stress at the former's rotor-cylindrical sheet-connection as well, caused by the stiffer compression springs 6. The performance of this combination can still be varied via the spring-supporters 7, i.e. by retaining various amounts of combustion gases per cycle (for different amounts of injected fuel).

Figure 3A:
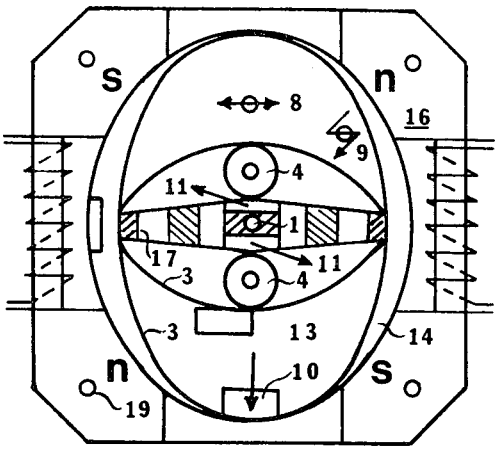

In the FIGS. 3,4 engine-generator, both rollers 4 may be substituted by two pairs of small rollers (ballbearings) attached to protruding shafts within the S-poles of the (enlarged) permanent magnets 17, and running within an oval channel in both end-plates, not extending beyond the inner cylinder's plane sides. This alteration greatly increases the volume of the latter (for the air-charging of the outer hemicylinders), and the stability of the whole combination as well, because two rotors 2 at shafts 1 may carry the (usually brittle) magnets 17, when slightly displacing the central intake port 11 and valve 12 therein. Moreover, the ports may be punched out of the end-plates symmetrically, but the exhaust port 10 moved to the site of the (second) intake port 11, so that both (upper and lower) hemicylinders are utilized for power strokes and the engine runs in a true 2-cycle fashion, i.e. with simultaneous exhaust (through 10) and intake (through 13).

Finally, the FIGS. 5,6,7 engine may easily be modified for an intermittent Stirling-operation, i.e. expansion at high, and compression at low temperatures, as follows: The cold air within the fully expanded right, upper hemicylinder of FIG. 6*a*, is compressed therein according to FIGS. 6*b* and *c*, and only transferred into a similarly dimensioned heat exchanger duct 13, extending not only to port 11, but another in the vicinity of the spark plug 9, via a threeway-valve 12, which remains closed until the position depicted by FIG. 6*d* has been reached. Then, the meanwhile heated duct-air is allowed to enter the left, flexed hemicylinder at the plug 9-port, and to expand like that heated in the preceding and following combustion. By the end of said expansion, depicted by FIG. 6c, the modified valve 12 is reset to the initial communication with port 11, e.g. by a thermostat, also reactivating the interrupted injector 8 and spark plug 9. Variously, said modification may be built and operated symmetrically, i.e. with heat-absorbing fins 15 within both cylinders, as well as exhaust and intake ports 10, 11, and valves 12 at both sides, in order to run the Otto- and Stirling-cycles intermittently in either the left, or right central hemicylinder (while closing the non-utilized ports respectively), thus providing for a shorter, more uniform heat-flow.

Since every motor may be utilized as the reciprocal generator, the engines according to this invention can also be operated with gases of increased or reduced pressure, and liquids as well, charged to their intake or exhaust ports respectively. Variously, they may be driven like pumps, e.g. by said electric motors, for moving liquids or generating gas-pressure different from atmospheric pressure, such as in refrigerators and heat-pumps.

Evidently, said equivalent derivations require minor variations, additions and/or omissions, as mentioned above for specific embodiments. They are applicable, however, for others also and shall not be repeated. Thus, for example, the shape and/or location of most parts, depicted herein, has been chosen for visual clarity, and not for technological superiority. Accordingly, the flexible cylinders' shape has been simplified, that of the springs, plugs, ports, valves, ducts, magnets, commutator, screws and gears as well, and many are located at sites with the least obstruction by other parts. However, it should be noted that, for example, injectors, plugs, ports and valves may also be located at the rotors, attached to hollow shafts. The former may, of course, be omitted if carbureted air is utilized at low compression ratios, and the latter may be increased by proper extension of the rotors into the non-varying volume of the cylinders, as mentioned for the FIG. 8 engine's housing 29. Therein, the transferral ducts 13, and valves 12 inside, may be omitted also, if the apical portions of the housing's side-plates are slightly recessed (aplanar), so that compressed air from the housing may enter the cylinder through the gap between said plates and the apex of the cylindrical sheet (but prevent combustion gases from escaping through it), thus greatly diminishing the cylinder-plate friction. In this connection it should be noted that any imperfections at the cylinder-plate-contacts become negligible at high vibration frequencies, what is the reason also for starting the engine at full speed, as mentioned for the engine-generators of FIGS. 1 to 4.

Due to the true technological progress in the chemical and electrical arts (as contrasted by the stagnation and fashion-domination in the motor vehicle arts), a large number of new materials is available for the few essential parts of the engines according to this invention. Thus, for example, steel has been perfected to such degree that blades thereof remain highly flexible and durable, even in the form of excessively thin and perforated sheets present in the vibrator-type electric razors, whose drive may, of course, vibrate the flexible cylinders 3 also. Accordingly, stainless steel may be utilized for the latter most successfully, but also nonmagnetic materials for said engine-generators, such as Teflon-coated duralumin, or even non-metallic composites (for sufficiently ventilated embodiments), such as glass or graphite fiber-Teflon composites.

Said cylinders' various thermal (linear) expansion can easily be duplicated for the cheaper and/or lighter housings thereof, by said stacking of a plurality of stamped sheets, whose average expansion coefficient, and/or that of the screws 19, must match that of the cylindrical sheet, in order to minimize friction and abrasion at the rigid end-plates. If, for example, the soft iron, utilized in said engine-generators, expands quite differently (at the respective temperature ranges) than the duralumin of the cylinder, the interspersed Eddy-insulators and fins 15, even glass or ceramic plates/fibers, may compensate for the difference.

The rigidity (planarity) of the cylinders' end-plates may not only be preserved with larger amounts of material used for them, but also by attaching vertical fins 15 thereon and/or an internal wafer or cell (porous) structure thereof. Variously, a relatively thin steel sheet may be stacked against a thicker magnalium or fibrous ceramic (Eternit) plate. In case the rotors 2 are utilized for the opening and closing of ports within said plates, their frictional contact thereon, and similar expansion with the cylinder, is necessary also. Therefore, their stacking from sheets, as mentioned above, will be advantageous also, and their connection to the cylinder-tube achieved with bolts, or via spot-welding. Variously, the cylindrical sheets may be bent at their ends and inserted into slits of the rotor, or stacked alongside the other sheets thereof, thus avoiding disconnections or bolt-loosenings at the cylinder-rotor-interface. Also permanent and electric magnets may be interchanged.

If not mentioned already, the engines according to this invention are constructed of any suitable and cheap material utilized for purpose-similar parts, and by conventional engineering techniques.

I claim:

1. An engine comprising:

chamber means defined by sheet means comprising a pair of flexible rectangular sheets, each sheet having corresponding first parallel edges and corresponding second parallel edges, said sheets being attached to each other along corresponding first parallel edges, and plate means comprising a pair of rigid parallel plates contacting said sheets along said second parallel edges, thereby forming a flexible variable capacity chamber between them, flexing means comprising a rotatable shaft connected to a rotor and first attachment means connecting one of said corresponding first parallel edges of said sheets to said rotor at a radial distance from said shaft, support means comprising a stationary support and second attachment means connecting the other of said first parallel edges to said support, inlet and outlet means within said plate means for communicating said chamber with the atmosphere, ignition means supported in said plate means and communicating with said chamber, fuel injection means in communication with said chamber, and a mechanical energy to electrical energy conversion means comprising a motor/generator connected to said rotatable shaft.

2. An engine according to claim 1, wherein said inlet means is in the form of a recess in at least one of said rigid plates, said recess allowing the atmosphere to communicate with said chamber between at least one of said rigid plates and at least one of said second parallel edges of said sheets.

3. An engine according to claim 1, wherein said inlet means is in the form of a port communicating the chamber on one side of at least one of said rigid plates to the atmosphere on the other side of at least one of said rigid plates.

4. An engine as in claim 1, wherein said second attachment means is in the form of a pivot and said first attachment means is in the form of a pivot.

5. An engine as in claim 1, wherein said second attachment means rigidly attaches said first parallel edges to said support means, and said first attachment means is in the form of a slot defined in said second parallel edges and a pin attached to said rotor to be received in said slot.

6. An engine according to claim 1, wherein said rotor is periodically geared to said electric motor/generator.

* * * * *